US005100308A

United States Patent [19]

Gevelhoff et al.

[11] Patent Number: 5,100,308

[45] Date of Patent: Mar. 31, 1992

[54] VANE PUMP WITH ADJUSTABLE HOUSING AND METHOD OF ASSEMBLY

[75] Inventors: Friedhelm Gevelhoff; Detlef Radtke; Dieter Frohn, all of Wuppertal; Hans-Heinrich Henning, Ennepetal, all of Fed. Rep. of Germany

[73] Assignee: Gebr. Becker GmbH & Co., Wuppertal, Fed. Rep. of Germany

[21] Appl. No.: 498,850

[22] Filed: Mar. 26, 1990

[30] Foreign Application Priority Data

Mar. 25, 1989 [DE] Fed. Rep. of Germany ..... 3909831

[51] Int. Cl.[5] ..... F04C 18/344

[52] U.S. Cl. ..... 418/30; 418/179; 418/210; 418/152

[58] Field of Search ..... 418/13, 30, 31, 134, 418/178, 179, 181, 210, 152; 403/357

[56] References Cited

U.S. PATENT DOCUMENTS

| | | | |
|---|---|---|---|
| Re. 31,870 | 4/1985 | Wagner | 403/357 |
| 789,774 | 5/1905 | Walda | 418/210 |
| 2,309,148 | 1/1943 | Wilson | 418/30 |
| 3,180,271 | 4/1965 | Hartmann | 418/210 |
| 3,447,477 | 6/1969 | Pettibone | 418/135 |
| 3,642,388 | 2/1972 | Maistrelli | 418/30 |
| 3,664,776 | 5/1972 | Mills et al. | 418/30 |
| 3,743,443 | 7/1973 | Dworak | 418/30 |
| 3,955,905 | 5/1976 | Frommholz | 403/357 |
| 4,201,521 | 5/1980 | Carlson | 418/131 |
| 4,204,815 | 5/1980 | Le Blanc | 418/13 |
| 4,496,228 | 1/1985 | Nakamura | 418/30 |
| 4,505,655 | 3/1985 | Honaga | 418/135 |
| 4,792,713 | 12/1988 | Bush | 403/357 |

FOREIGN PATENT DOCUMENTS

| | | | |
|---|---|---|---|
| 564528 | 10/1930 | Fed. Rep. of Germany . | |
| 807977 | 7/1951 | Fed. Rep. of Germany . | |
| 3603809 | 8/1987 | Fed. Rep. of Germany . | |
| 59-147895 | 8/1984 | Japan | 418/210 |
| 257521 | 10/1948 | Switzerland . | |

*Primary Examiner*—Richard A. Bertsch
*Assistant Examiner*—David L. Cavanaugh
*Attorney, Agent, or Firm*—Peter K. Kontler

[57] ABSTRACT

A vacuum vane pump wherein one or more stages are installed in an annular extension of the casing for the pump motor. Each stage has a rotor which is driven by the motor shaft by way of an elastic key, and an annular housing which surrounds and is eccentric relative to the rotor. The housing is pivotable about a pintle which is installed in the end walls of the casing and is parallel to the motor shaft. The width of an annular clearance between the external surface of the housing and the internal surface of the extension can be varied by a radially disposed screw which is mounted in the extension diametrically opposite a spring-loaded abutment for the housing. The components of each stage are biased to predetermined axial positions by springs which react against the extension and bias one end wall of the casing against the adjacent housing and rotor, either directly or by way of a partition. Such biasing is effected upon completed final adjustment of each housing relative to the respective rotor in the radial direction of the extension.

30 Claims, 3 Drawing Sheets

VANE PUMP WITH ADJUSTABLE HOUSING AND METHOD OF ASSEMBLY

BACKGROUND OF THE INVENTION

The invention relates to fluid flow machines in general, and more particularly to improvements in machines which can be used as vacuum vane pumps or vane compressors.

A vane pump can comprise one or more stages, and each stage of a standard vane pump comprises a rotor which is secured to a motor-driven shaft and is spacedly surrounded by an eccentrically mounted housing. The peripheral surface of the rotor has one or more substantially radially extending axially parallel slots for vanes which tend to move radially outwardly and abut the internal surface of the eccentrically mounted housing when the rotor is driven. It is also known to mount the rotor and the housing in an annular wall which carries two end walls flanking the rotor and the housing. If such pump is to be used for the generation of high vacua, its parts must be machined and assembled with a high degree of accuracy. The situation is aggravated if the vacuum pump is a multistage pump. Precise axial and radial positioning of each housing and precise axial positioning of each rotor takes up much time and must be carried out by skilled persons. The procedure is repeated, with renewed losses in time, when a dismantled high vacuum vane pump is to be reassembled subsequent to inspection, repair or replacement of one or more parts.

Examples of conventional vane pumps are those disclosed in German Pat. No. 807,977 Ganster, in German Pat. No. 564,528 to Stiebling, in Swiss Pat. No. 257521 to Wüthrich and in published German patent application No. 36 03 809 of Kossek. The patent to Ganster proposes to surround the rotor with a slotted sleeve which has an internal surface engageable by the radially movable vanes of the rotor, and the diameter of such internal surface is adjustable in order to compensate for wear as a result of sliding engagement between the radially outermost portions of the vanes and the slotted sleeve. Stiebling discloses a cylindrical sleeve which surrounds and is biased against the rotor of the machine (which is used as a compressor) by a spring-biased yoke. Wüthrich discloses a vane pump wherein the rotor is surrounded by a radially movable housing; the latter has a slot for the treated fluid and its position relative to the rotor (in the radial direction of the rotor) is changed automatically as a function of changes of pressure of the conveyed fluid medium. Kossek discloses a two-stage vane pump and is concerned with automatic evacuation of condensate.

OBJECTS OF THE INVENTION

An object of the invention is to provide a fluid flow machine which can be used as a pump or as a compressor and is constructed and assembled in such a way that its parts can be adjusted in a simple and time saving manner to provide an optimum vacuum generating or compressing action.

Another object of the invention is to provide a machine which is constructed and assembled in such a way that it can be readily adjusted to compensate for manufacturing tolerances of its parts.

A further object of the invention is to provide a vane pump or vane compressor which can be assembled in a novel and improved way.

An additional object of the invention is to provide the machine with novel and improved means for changing the position of the housing with reference to the rotor of a single-stage machine or the position of the housing with reference to the rotor in each stage of a multistage machine.

Still another object of the invention is to provide a machine which can but need not be lubricated, which is designed to compensate for thermally induced expansion or contraction of its parts, and which can be used as a high vacuum pump.

Another object of the invention is to provide a machine wherein at least some if not all of the components can be mass produced in available machines.

A further object of the invention is to provide a machine which can be readily adjusted to alter its vacuum generating or compressing action.

An additional object of the invention is to provide a novel and improved method of assembling a single-stage or multistage vane pump or compressor.

Another object of the invention is to provide the machine with novel and improved means for facilitating the assembly and preliminary adjustments of its parts.

A further object of the invention is to provide a novel and improved casing for the components of the above outlined machine.

An additional object of the invention is to provide a pump wherein the fluid-conveying parts are simple and inexpensive and can be made of any one of a plurality of different materials which are best suited for specific applications of the pump.

SUMMARY OF THE INVENTION

One feature of the present invention resides in the provision of a fluid flow machine (hereinafter called pump or vane pump for short) which comprises a rotor having a peripheral surface and at least one slot in its peripheral surface, a housing (e.g., a circumferentially complete annulus) having an internal surface which surrounds with clearance the peripheral surface of the rotor, a vane which is movable in the at least one slot and abuts the internal surface of the housing when the rotor is driven, and a casing having an annular wall which surrounds the housing and defines with the latter a substantially annular clearance. The housing is movable relative to the casing substantially radially of the rotor. The pump further comprises means for moving the housing with reference to the casing in directions to change the eccentricity of the internal surface with reference to the peripheral surface, and means for rotating the rotor about a predetermined axis.

The pump can further comprise a pintle which is mounted in the casing and in the housing and defines for the housing a pivot axis extending in substantial parallelism with the predetermined axis. The casing further comprises end walls which flank the rotor and the housing, and the pintle has portions which are mounted in such end walls. The housing can be provided with a hole or bore serving to receive a portion of the pintle with a clearance which preferably matches or exceeds the clearance between the housing and the annular wall of the casing. The pintle can be said to constitute a means for pivotably mounting the housing in the casing.

The means for moving the housing with reference to the casing can comprise a screw or another suitable threaded moving member which is rotatably mounted in and mates with the annular wall. The movements of the housing relative to the casting under the action of the moving member are preferably opposed by means for yieldably biasing the housing against the moving member. To this end, the inner end of the moving member extends inwardly beyond the annular wall and is adjacent the housing, and the biasing means can include a spring-loaded abutment which is mounted in the annular wall and urges the housing against the inner end of the moving member. The latter can be disposed substantially radially of the annular wall and substantially diametrically opposite the abutment.

The improved pump can constitute a multistage pump. The pump then comprises at least one second rotor which is coaxial with the first named rotor and has a peripheral surface with at least one second slot, a second housing which surrounds the second rotor and has an internal surface which is eccentric with reference to the peripheral surface of the second rotor, and a second vane which is movable in the at least one second slot and abuts the internal surface of the second housing when the rotors are driven. The casing preferably includes a partition between the first named rotor and the first named housing on the one hand, and the second rotor and second housing on the other hand. Such multistage pump preferably further comprises means for moving the second housing relative to the annular wall and relative to the second rotor independently of the first named housing and substantially radially of the second rotor. The second housing can be identical with the first named housing and is or can be angularly offset with reference to the first named housing through an angle of substantially 180°. The first named housing and the first named rotor define at least one first pumping chamber, and the second rotor and the second housing define at least one second pumping chamber. The outlet of the first chamber is in communication with the inlet of the second pumping chamber by way of at least one passage which is provided in the partition between the first and second rotors.

As stated above, the casing includes first and second end walls which flank the stage or stages, and the pumping preferably further comprises means for biasing one of the end walls toward the other end wall. The rotor and the housing of each stage are movable axially of the rotor or rotors toward the other end wall in response to the application of bias to the one end wall. The biasing means can include at least one coil spring and/or any other suitable spring which (directly or indirectly) reacts against the annular wall and bears upon the one end wall to urge the one end wall toward the other end wall.

The means for rotating the rotor or rotors can comprise a motor-driven shaft and at least partially elastic means for transmitting torque between the shaft on the one hand and the rotor or rotors on the other hand. To this end, each rotor and the shaft can be provided with axially parallel grooves for one or more keys which are received in such grooves and constitute the torque transmitting means.

The housing or housings, the rotor or rotors, the annular wall, the vane or vanes, the partition or partitions and/or the end walls of the improved vane pump can constitute molded (e.g., injection molded or extruded) plastic articles. At least one such plastic article can consist of carbon-containing synthetic material which preferably exhibits satisfactory or excellent self-lubricating properties.

The arrangement may be such that each of the parts including the one end wall, the partition or partitions between the stages of a multiple stage pump, the rotor or rotors and the housing or housings can be secured to the annular wall in any one of a number of different angular positions (i.e., in any one of four different angular positions at 90-degree angles to each other) in order to ensure that the inlet or inlets of the pumping chambers will be disposed at selected levels when the pump is in actual use. This renders it possible to control the flow of condensate if the pump is a vacuum vane pump.

If the pump is a vacuum pump, the one end wall can be provided with at least one gas-admitting port and the other end wall (which is or can be integral or rigidly connected with the annular wall) can be provided with a gas-evacuating channel. The shaft of the rotating means preferably extends through the other end wall, and the latter has a side facing the adjacent rotor and housing. The aforementioned gas-evacuating channel can constitute an annular groove in such side of the other end wall.

The pumping chamber of each stage of the improved pump has portions of maximum and minimum width (as considered in the radial direction of the respective rotor), and such portions of maximum and minimum width are located in or very close to a first plane which includes the predetermined axis. The aforementioned pintle defines for each housing a pivot axis which is at least substantially parallel to the predetermined axis. The two axes are located in a second plane which is preferably normal or substantially normal to the first plane.

Another feature of the present invention resides in the provision of a method of assembling and adjusting a vane pump, particularly a high vacuum vane pump. The method comprises the steps of mounting a pump rotor in an annular wall for rotation about a predetermined axis, interposing an annular pump housing between the annular wall and the rotor in a position of eccentricity with reference to the rotor, and changing the eccentricity of the housing with reference to the rotor. The method can further comprise the steps of driving the rotor about the predetermined axis in the course of the eccentricity changing step so that the vacuum generating action of the pump varies as a result of the eccentricity changing step, and fixing the housing against movement relative to the rotor and the annular wall when the vacuum generating action of the pump reaches a desired value.

If the method is to involve the assembly of a multistage pump, it further comprises the steps of mounting in the annular wall a second rotor for rotation about the predetermined axis, interposing a second annular pump housing between the second rotor and the annular wall in a position of eccentricity with reference to the second rotor, and changing the eccentricity of the second housing with reference to the second rotor independently of the first named housing. One of the eccentricity changing steps can precede the other eccentricity changing step.

The method can further comprise the step of moving the rotor and the housing of each stage to predetermined axial positions upon completion of the last eccentricity changing step. This can involve subjecting the rotor and the housing of each stage to the action of at least one spring which yieldably maintains the housing and the rotor of each stage in predetermined axial positions. The moving step can include positioning the rotor or rotors and the corresponding housing or housings between two spaced-apart end walls and moving one of the end walls toward the other end wall in the direction of the predetermined axis. This method can further comprise the step of interposing between the annular wall and the one end wall one or more springs which react against the annular wall and bear upon the one end wall to bias the latter toward the other end wall and to thus bias the rotor or rotors and the housing or housings to the predetermined axial positions.

The novel features which are considered as characteristic of the invention are set forth in particular in the appended claims. The improved fluid flow machine itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
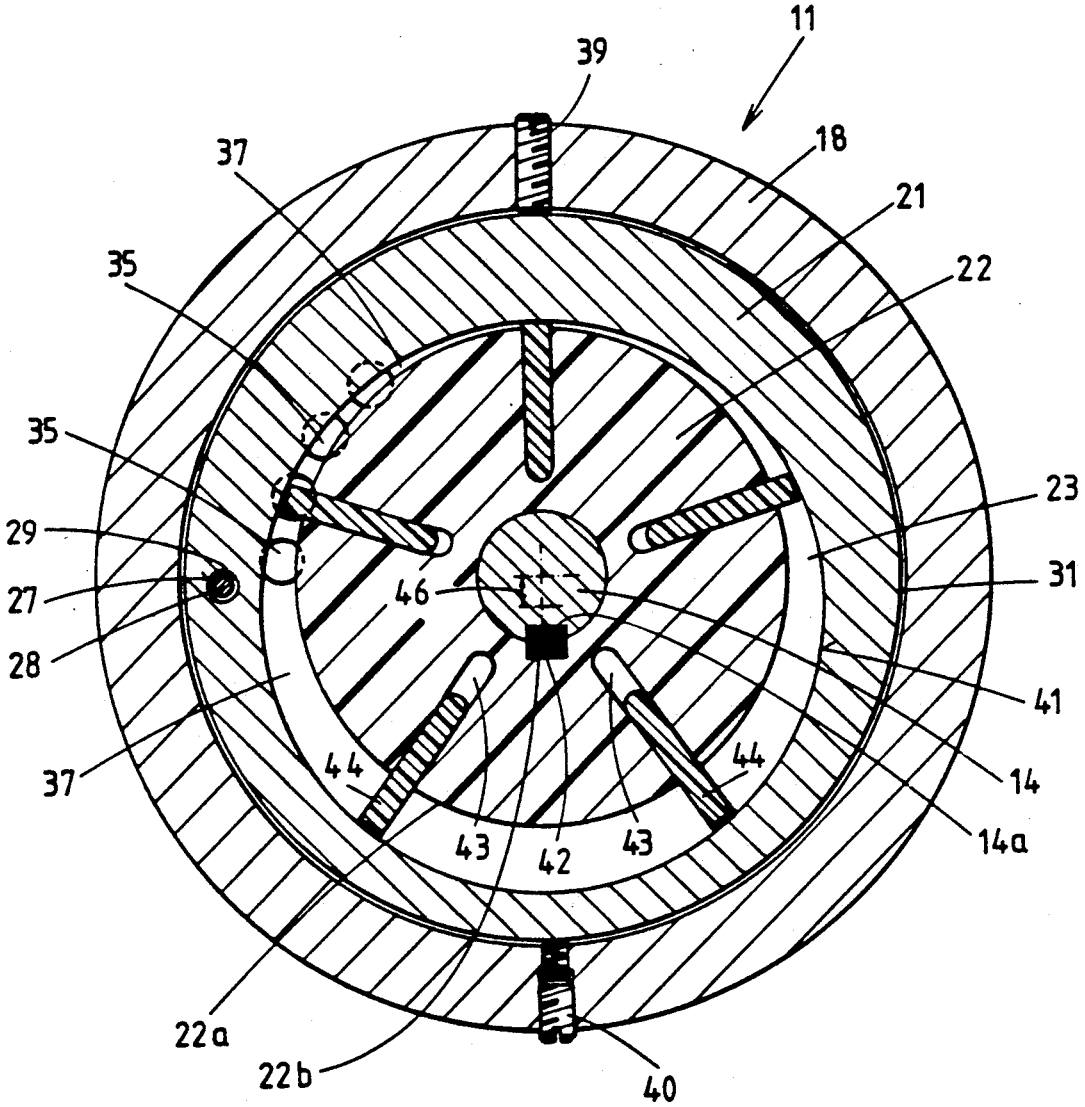
FIG. 1 is a transverse sectional view of one stage of a multistage fluid flow machine which is designed to be used as a high vacuum vane pump.
Figure 2:
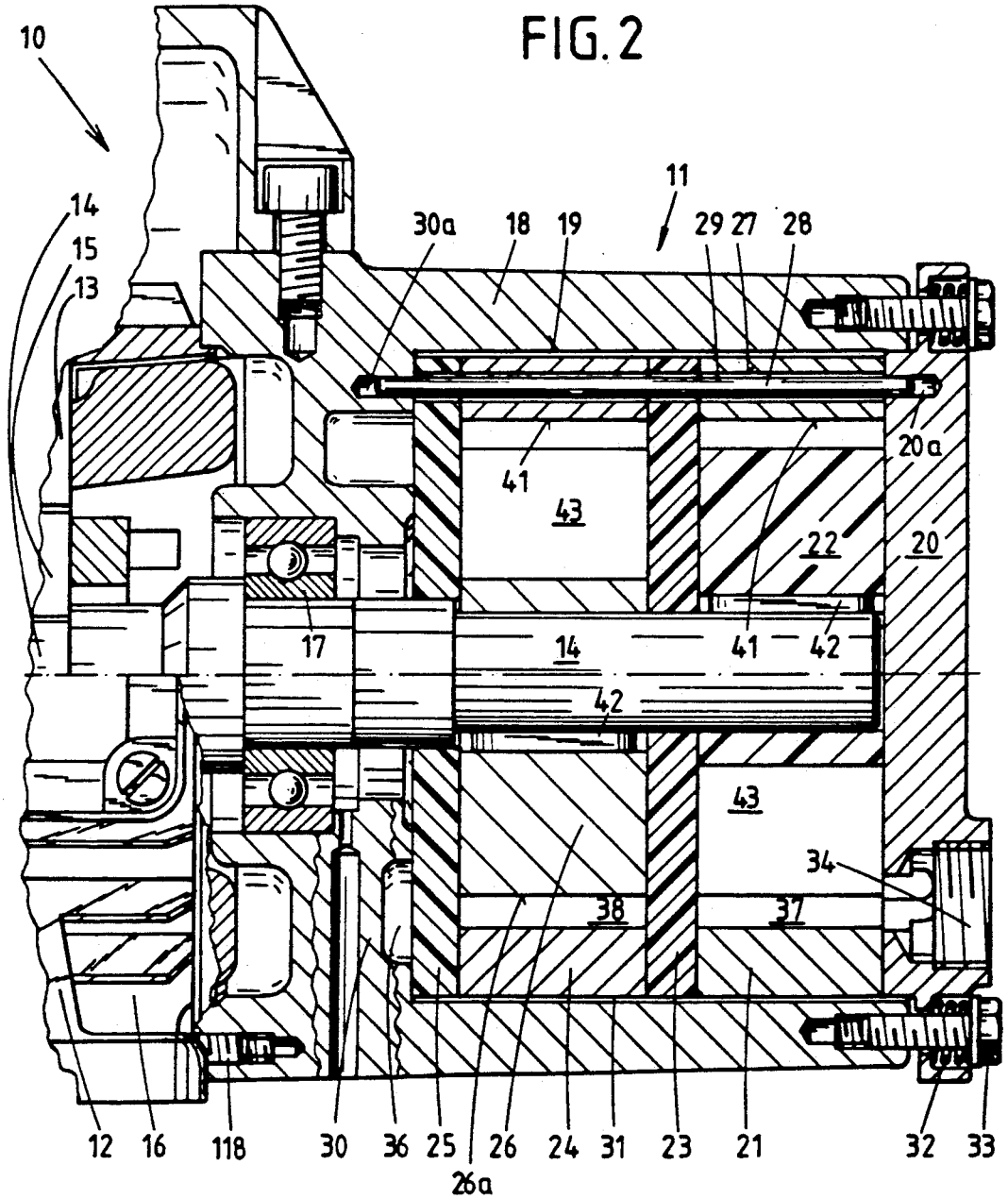
FIG. 2 is a fragmentary axial sectional view of the fluid flow machine which is shown in FIG. 1.

FIGS. 1 and 2 show a two-stage vane pump 11 with coaxial rotors 22, 26 which are driven by the output shaft 14 of an electric motor 10. The motor 10 is installed in a casing 12 having an annular extension or wall 18 which surrounds the two stages of the pump 11. FIG. 2 merely shows a portion of the stator 13 which is fixedly installed in the casing 12, and a rotor 15 which is surrounded by the stator 13 and is connected to the shaft 14. The casing 12 is further provided with external heat dissipating ribs 16.

The shaft 14 is rotatably journalled in several bearings including an antifriction ball bearing 17 which is shown in FIG. 2. The bearing 17 surrounds the shaft 14 between the rotor 15 and a fixed end wall 30 of the casing 12. If desired or necessary, the annular wall 18 can constitute a detachable part of the casing 12. This is shown in FIG. 2 wherein the separately produced annular wall 18 is separably affixed to the major section of the casing 12 by bolts 118 (only one shown). The end wall 30 is an integral part of the annular wall 18. However, it is equally within the purview of the invention to employ a casing 12 wherein the section confining the electric motor 10 is integral with the annular wall 18. The latter defines a cylindrical compartment 19 one end of which is disposed at the end wall 30 and the other end of which is disposed at a detachable end wall or cover 20 of the casing 12. The shaft 14 of the motor 10 extends well into the compartment 19 and terminates short of the inner side of the detachable end wall 20.

The vane pump 11 is a vacuum, particularly a high vacuum pump, and its first stage (including the rotor 22) is adjacent the detachable end wall 20. The second stage (including the rotor 26) is adjacent the end wall 30 and is separated from the first stage by a partition 23. A second partition 25 is installed between the second stage and the end wall 30.

The first stage of the pump 11 further comprises a housing 21 which is a circumferentially complete annulus with a cylindrical internal surface 41 eccentric with reference to and surrounding the clearance the peripheral surface 22*a* of the rotor 22. The eccentricity 46 (FIG. 1) of the common axis of the shaft 14 and rotor 21 with reference to the axis of the internal surface 41 determines the volumetric displacement of the first stage of the pump 11. The peripheral surface 22*a* of the rotor 22 has several equidistant substantially or exactly radially extending slots 43 for plate-like vanes 44 which move radially outwardly under the action of centrifugal force and abut the internal surface 41 of the housing 21 when the motor 10 drives its shaft 14 which, in turn, rotates the rotor 22.

The first stage of the pump 11 is flanked by the end wall 20 and partition 23, and the second stage of the pump 11 is flanked by the two partitions 23, 25. The second stage further comprises a circumferentially complete annular housing 24 having a cylindrical internal surface 41 which is eccentric with reference to and surrounds with clearance the peripheral surface 26*a* of the respective rotor 26. The peripheral surface 26*a* is also provided with substantially radially inwardly extending slots 43 for vanes corresponding to vanes 44 and abutting the internal surface 41 of the housing 24 under the action of centrifugal force when the motor 10 drives its shaft 14 and the rotors 22, 26.

The housings 21, 24 are pivotable about the axis of an elongated pintle 28 the end portions of which are snugly received in aligned coaxial blind bores or holes 20*a*, 30*a* of the end walls 20 and 30. The median portion of the pintle 28 is received, with annular clearance 29 in bores or holes 27 of the housings 21, 24 and partitions 23, 25.

The outer diameters of the housings 21, 24 and partitions 23, 25 are smaller than the inner diameter of the annular wall 18 of the casing 12. This establishes an annular clearance 31 between the housings 21, 24 and partitions 23, 25 on the one hand, and the annular wall 18 on the other hand. The outer diameters of the partitions 23, 25 preferably match the outer diameters of the housings 21, 24 and the components 21, 23, 24, 25 can constitute a hollow cylinder with a smooth peripheral surface. The width of the annular clearance 31 need not exceed a fraction of one millimeter. It is presently preferred to select the inner diameter of the annular wall 18 and the outer diameters of the housings 21, 24 in such a way that the minimum width of the clearance 31 is not less than 1/10 mm. The clearance 31 provides room for movements of the housings 21, 24 substantially radially of and relative to the peripheral surfaces 22*a*, 26*a* of the respective rotors 22, 26.

The fluid flow machine of FIGS. 1 and 2 further comprises means for yieldably biasing the components or parts of the two pump stages to predetermined positions as seen in the axial direction of the shaft 14. Such biasing means comprises several coil springs 32 or other suitable resilient elements which indirectly react against the annular wall 18 and bear upon the end wall 20 to urge the latter toward the end wall 30. Each coil spring 32 surrounds the externally threaded shank of a discrete bolt 33 which extends into a tapped bore in the adjacent end face of the annular wall 18. The heads of the bolts 33 are recessed into the end wall 20, and the recesses for such heads are bounded by bottom surfaces which are acted upon by the respective springs 32. These springs react against the heads of the respective bolts 33, i.e., indirectly against the annular wall 18 of the casing 12.

The end wall 20 is provided with a gas-admitting port 34 which communicates with the crescent-shaped pumping chamber 37 between the peripheral surface 22a of the rotor 22 and the internal surface 41 of the housing 21. The partition 23 is provided with one or more passages 35 which establish a path for the flow of gaseous fluid from the chamber 37 into a similar crescent-shaped pumping chamber 38 between the peripheral surface 26a of the rotor 26 and the internal surface 41 of the housing 24. The partition 25 has one or more passages (corresponding to the passages 35 in the partition 23) serving to establish a path for the flow of a fluid medium between the pumping chamber 38 and a gas-evacuating channel 36. This channel is an annular groove in that side of the end wall 30 which faces the stages of the pump 11, i.e., which is adjacent the partition 25. Air or another gaseous fluid is drawn into the chamber 37 by way of the port 34 in the end wall 20, and such fluid then flows through the passage or passages 35 of the partition 23 into the chamber 38. The fluid then flows through the passage or passages of the partition 25 into and is discharged from the channel 36.

In accordance with a feature of the invention, the pump 11 is further provided with discrete means for moving the housings 21, 24 relative to the respective rotors 22 and 26 in directions substantially radially of the rotors. The moving means comprises screws or analogous externally threaded moving members 39 (one shown in FIG. 1) which are rotatable relative to and mate with the annular wall 18 to move substantially radially of the wall 18. The inner end portions or tips of the screws 39 are located in the compartment 19 of the annular wall 18 and can move the respective rotors 22, 26 against the opposition of discrete biasing means 40 which are installed in the annular wall 18 and constitute spring-loaded abutments disposed substantially diametrically opposite the respective screws 39. The abutment 40 for the rotor 22 of the first stage of the pump 11 is shown in FIG. 1.

By changing the positions of the housings 21, 24 relative to the respective rotors 22, 26, an operator can change the vacuum generating action of the pump 11. A two-stage vane pump 11 of the type shown in FIGS. 1 and 2 can be adjusted to create vacua of less than 10 millibar. The springs of the abutments 40 invariably maintain the housings 21, 24 in contact with the inner end portions of the respective screws 39 as long as the inner end portions of these screws extend into the compartment 19, i.e., beyond the internal surface of the annular wall 18. The operator in charge of adjusting the pump 11 can select the width of portions of annular clearance 31 between the annular wall 18 and the housings 21, 24 by rotating the respective screws 39 in a clockwise or in a counterclockwise direction. The movements of the housings 21, 24 are or can be pivotal movements about the axis of the pintle 28, i.e., about an axis which is spaced apart from and is parallel to the axis of the motor shaft 14. Such pivotability of the housings 21, 24 relative to the pintle 28 can serve the additional purpose of compensating for eventual manufacturing tolerances of the outer diameter of the rotor 22 and/or 26 as well as for manufacturing tolerances of the inner diameter of the housing 21 and/or 24. This renders it possible to generate high vacua even if the components or parts of the pump stages are not machined with utmost precision.

The shaft 14 of the motor 10 is provided with axially parallel grooves 14a (one shown in FIG. 1 for at least slightly elastic keys 42 which serve as means for transmitting torque from the shaft 14 to the rotors 22, 26. The elastic key 42 of FIG. 1 extends into the groove 14a of the shaft 14 as well as into the groove 22b of the rotor 22.

FIG. 1 shows that the axes of the screw 39 and abutment 40 are located in a first plane which is very close to or includes the axis of the shaft 14. The maximum-width and minimum-width portions of the pumping chamber 37 are also located in this plane, the same as the region of maximum eccentricity 46 of the internal surface 41 of the housing 21 relative to the peripheral surface 22a of the rotor 22. The axes of the pintle 28 and shaft 14 are located in a second plane which is normal or at least substantially normal to the first plane. By rotating the screw 39, the operator can alter the extent of maximum eccentricity of the axis of the housing 21 relative to the axis of the rotor 22. The same applies for adjustments of the housing 24 relative to the rotor 26 in the second stage of the vane pump 11. Such adjustability of the housings 21, 24 relative to the respective rotors 22, 26 renders it possible to compensate for pronounced manufacturing tolerances while still permitting highly accurate adjustment of the eccentricity 46 of each housing and highly accurate adjustment of minimum width of portions of the clearance 31. This renders it possible to avoid pronounced frictional engagement between and resulting extensive wear upon neighboring components of each stage. Final adjustments by way of the screws 39 are carried out upon completion of installation of various components in the compartment 19 of the annular wall 18. This simplifies the assembly because it is not necessary to install components which are already accurately adjusted relative to each other. Final adjustment renders it possible to generate high vacua in spite of eventual manufacturing tolerances.

The provision of relatively large holes or bores 27 in the housings 21, 24 and in the partitions 23, 25 facilitates the assembly of such components on the pintle 28 while also permitting precise adjustments of the housings 21, 24 relative to the respective rotors 22, 26 subsequent to introduction of these components into the compartment 19 of the annular wall 18. As mentioned above, the width of the clearance 29 between the peripheral surface of the respective portion of the pintle 28 and the surfaces surrounding the bores or holes 27 of the components 21, 23, 24 and 25 preferably matches or exceeds the maximum width of the clearance 31 between the surface surrounding the compartment 19 and the peripheral surfaces of the components 21, 23, 24 and 25. This renders it possible to properly align the housings 21, 24 with the partitions 23, 25 while still permitting desirable final adjustments of the housings 21, 24 relative to the rotors 22, 26 and annular wall 18. Moreover, such selection of the width of the clearance 28 renders it possible to take full advantage of the width of the clearance 31.

The abutments 40 can be omitted if the orientation of the pump 11 is such that the housings 21, 24 tend to abut the inner end portions of the respective screws 39 under the action of gravity. However, spring-loaded abutments are preferred in many instances because reliable retention of housings 21, 24 in contact with the inner end portions of the respective screws 39 is not dependent upon the orientation of the housings and of the annular wall 18.

The partitions 23 and 25 constitute desirable but optional features of the improved pump. These partitions can be made of a material which permits highly accurate adjustments of the positions of housings 21, 24 relative to the respective rotors 22, 26 with a minimum of effort. Moreover, the partitions reduce the likelihood that radial adjustments of one of the housings 21, 24 could alter the radial adjustment of the other housing. While it is possible to employ means for jointly moving the housings 21, 24 relative to the corresponding rotors 22 and 26, it is presently preferred to employ discrete moving means (such as screws 39) because this enhances the accuracy of adjustment of each housing with reference to the annular wall 18 and particularly with reference to the associated rotor.

The provision of passages 35 in the partition 23 and of similar passages in the partition 25 ensures that the paths for the flow of a fluid medium between the chambers 37, 38 and between the chamber 38 and channel 36 are very short. Moreover, the cost of the pump is reduced because it is not necessary to provide specially designed elongated paths for the flow of a fluid medium between the pumping chambers and from the pumping chamber of the second stage into the channel 36. The partition 23 can be identical with the partition 25. The initial and maintenance costs of the improved pump are relatively low because the components of one stage can be identical with the components of the other stage.

The springs 32 maintain the components of the two stages in desired axial positions and compensate for thermally induced expansion or contraction of such components without permitting deformation of the end wall or cover 20. In addition, these springs serve as a means for preventing accidental or undesirable changes of positions of the housings 21, 24 relative to the annular wall 18 and/or rotors 22, 26 when the final adjustment by means of the respective screws 39 is already completed. Furthermore, the springs 32 render it possible to compensate for additional manufacturing tolerances, especially those which cause the partitions, the rotors and/or the housings to lie in planes which are not exactly normal to the axis of the shaft 14, i.e., to ensure proper assembly of the components of the two stages even if the axis of the one or the other rotor and/or partition does not exactly coincide with the axis of the shaft 14 and even if the axis of the one or the other housing is not exactly parallel to the axis of this shaft. Last but not least, the springs 32 can compensate for certain wear upon the components of the pump 11 when the latter is in actual use. It often happens that the axial positions of assembled parts change once the pump is in operation for a certain period of time, either as a result of wear or for other reasons; the springs 32 can compensate for such phenomena to ensure predictable operation of the pump for long periods of time.

The end wall 20 need not be immediately moved to its final axial position. This renders it possible to accurately select the radial positions of the housings 21, 24 relative to the annular wall 18 and the respective rotors 22, 26 with greater ease than if the radial movements of the housings were opposed by strongly compressed springs 32. These springs are compressed in response to further tightening of the bolts 33 which takes place when the final adjustments by means of the screws 39 are already completed.

The elastically deformable torque transmitting keys 42 also compensate for certain manufacturing tolerances without affecting the transmission of torque from the shaft 14 to the respective rotors 22 and 26. Another advantage of elastically deformable keys 42 is that they suppress noise which would be likely to develop in response to changes of rotational speed of the shaft 14, especially in response to abrupt changes of RPM.

The components of the pump 11 (particularly the partitions, the vanes, the housings and the rotors) can constitute mass-produced moldings which are turned out in available injection molding, extruding and like machines and require a minimum of secondary treatment or no secondary treatment at all. The reason is that the vane pump is designed to compensate for manufacturing tolerances not only due to the provision of the clearance 31 along the surface bounding the compartment 19 of the annular wall 18 but also due to the provision of clearance 29 around the pintle 28 and the utilization of elastically deformable torque transmitting keys 42. The presently preferred material of such mass-produced parts is a carbon-containing material, particularly electrographite or resin-impregnated electrographite. Such materials are available at the firm Ringsdorff, Bonn, Federal Republic Germany. Such material can be processed in available machines and exhibits desirable self-lubricating properties which is particularly important if the pump is a dry-running fluid flow machine.

It is desirable to design the components of the pump in such a way that they can be mounted in any one of several different angular positions, e.g., in several different angular positions at 90-degree angles to each other. This renders it possible to ensure that condensate, if any, will gather at the inlet and outlet of the fluid flow machine if the latter is used as a vacuum pump. For example, the inlet of such pump will normally be located at the lowest point to permit gravity-induced outflow of condensate.

An advantage of the annular channel 36 in that side of the end wall 30 which is adjacent the second stage of the pump 11 is that it permits reliable evacuation of spent air in each angular position of the components which form the two stages in the annular wall 18. This simplifies the assembly of the pump because the persons in charge need not be concerned with evacuation of fluids from the second stage, such evacuation being ensured in each and every angular position of the partition 25 relative to the end wall 30. Moreover, the channel 36 acts not unlike a resonance chamber which dampens noises when the pump is in use. Condensate, if any, invariably tends to gather in the lowermost portion of this chamber which simplifies evacuation of the condensate.

The feature that the axes of the screws 39 and the corresponding abutments 40 are located in common planes which include the axis of the shaft 14 renders it possible to employ identical housings 21 and 24 because these housings are simply turned through 180 degrees relative to each other.

Figure 3:
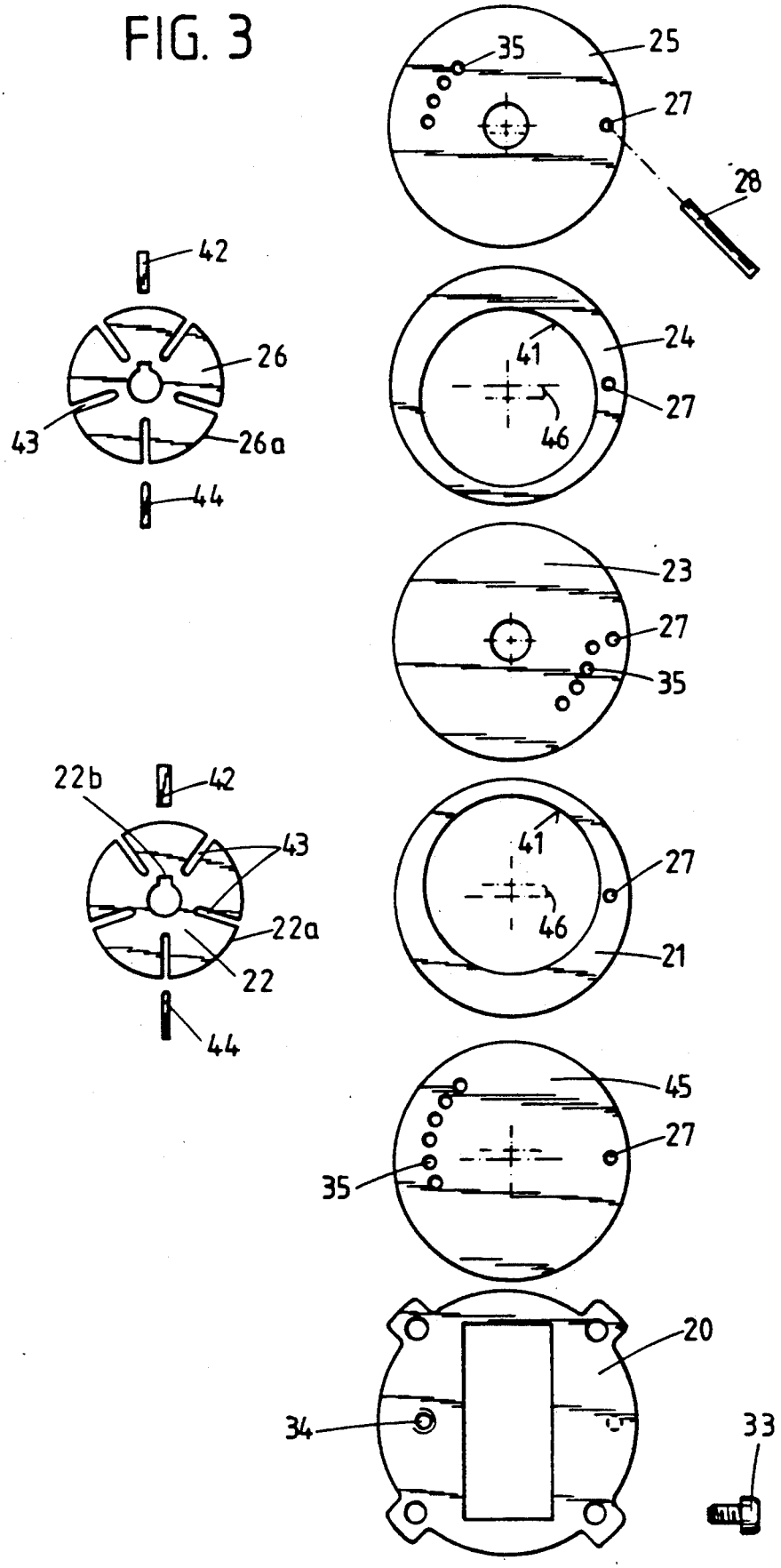
FIG. 3 shows the components of two stages of a slightly modified fluid flow machine prior to insertion into the annular wall of the casing.

FIG. 3 shows all components of the two pump stages plus a third partition 45 which is or can be identical with the partitions 23, 25 and is to be installed in the internal compartment 19 of the annular wall 18 between the rotor 22 and housing 21 on the one hand, and the end wall 20 on the other hand. The passages 35 of the third partition 45 serve to establish communication between the gas-admitting port 34 of the end wall 20 and the pumping chamber 37 between the rotor 22 and the housing 21 of the first stage of the vane pump. FIG. 3 further shows that the housings 21, 24 are identical but that these housings are to be installed in the annular wall 18 in such a way that they are mirror images of one another. In other words, when the housings 21, 24 are installed in the compartment 19 of the annular wall 18, the housing 21 is angularly offset by 180 degrees with reference to the housing 24.

The fluid flow machine of FIGS. 1 and 2 (with the third partition 45 of FIG. 3) is preferably assembled in the following way:

It is assumed that the annular wall 18 and the end wall 30 are already secured to the main section of the casing 12 by several threaded fasteners 118 and that the shaft 14 of the motor 10 extends through the end wall 30 and into the compartment 19 of the annular wall 18. One end portion of the pintle 28 is then inserted into the blind bore or hole 30*a* of the end wall 30 and the partition 25 is slid onto the shaft 14 so that its bore or hole 27 receives the pintle 28. The partition 25 is followed by the housing 24 which, in turn, is followed by the rotor 26. The slots 43 of the rotor 26 can receive the corresponding vanes 44 prior or subsequent to slipping of the rotor 26 onto the shaft 14 and into the housing 24. The rotor 26 is then coupled to the shaft 14 by the respective key 42.

The mounting of the rotor 26 is followed by insertion of the partition 23 so that the partition 23 is traversed by the shaft 14 as well as by the pintle 28. The person in charge then inserts the housing 21, followed by the rotor 22, the vanes 44 for the rotor 22 and the key 42 which is to transmit torque from the shaft 14 to the rotor 22. The next component to be inserted is the third partition 45 which is followed by the end wall 20. This end wall is loosely secured to the annular wall 18 by two or more bolts 33.

The motor 10 is started to drive the shaft 14 and the rotors 22, 26 while the person in charge manipulates the screws 39 to select the positions of the housings 21, 24 relative to the respective rotors 22, 26. The adjustment is completed when the vacuum generating action of the pump reaches an optimum value. The bolts 33 are thereupon tightened to ensure that the springs 32 (not shown in FIG. 3) maintain the components of the two stages in predetermined axial positions.

The adjustments of the housing 21 relative to the rotor 22 of the first pump stage can precede or follow the adjustments of the housing 24 relative to the rotor 26 of the second pump stage.

The purpose of the springs 32 is to compensate for thermally induced expansion or contraction of components in the compartment 19 of the annular wall 18. Thus, the end wall 20 can yield by moving axially of the shaft 14 and away from the end wall 30 in response to thermally induced expansion of the package including the partitions 23, 25, 45, the housings 21, 24 and the rotors 22, 26. Inversely, the springs 32 will dissipate energy and will move the end wall 20 toward the end wall 30 in response to cooling of the package including the components 23, 25, 26, 22, 26, 21 and 24. Radial expansion of the package of components in the compartment 19 is possible due to the provision of annular clearance 31 between the internal surface of the annular wall 18 on the one hand and the external surfaces of the partitions 23, 25, 45 and housings 21, 24 on the other hand.

It is possible to replace the relatively long pintle 28 with a shorter pintle which need not be anchored in the end wall 30. This renders it possible to assemble the partitions 23, 25, 45 and the housings 21, 24 on the relatively short pintle (with the rotors 22, 26 respectively installed between the partitions 23, 25 and 23, 25, and to insert the thus assembled components as a unit into the compartment 19 preparatory to final adjustment of the housings 21, 24 by way of the respective screws 39. The end wall 20 preferably carries one end portion of the relatively short pintle during insertion of the aforementioned unit into the compartment 19 of the annular wall 18. The short pintle renders it possible to carry out a coarse initial adjustment of the components of the two pump stages relative to each other as soon as the rotors 22, 26 are slipped onto the shaft 14, and such coarse adjustment is then followed by the aforementioned final or precise adjustment by way of discrete screws 39 for the housings 21 and 24. The last stage of assembly again involves tightening of the bolts 33 to cause the springs 32 to store energy and maintain the components of the two stages in optimum axial positions within the compartment 19. The end wall 20 preferably carries a substantial number (e.g., four, see FIG. 3) bolts 33 which are equidistant from each other in the circumferential direction of the annular wall 18.

The aforedescribed method of assembling the vane pump exhibits the advantage that the final adjustment takes up much less time than in accordance with heretofore known methods. A conventional pump is normally assembled in such a way that each and every component of the pump is individually inserted into and finally adjusted in the casing prior to insertion of the next-following component.

Another advantage of the improved method of assembling and adjusting the components of the vane pump of FIGS. 1–2 or FIG. 3 is that further adjustments (if and when necessary) take up little time and can be carried out with the same degree of accuracy as the initial final adjustments. All that is necessary is to loosen the bolts 33 in order to enable the springs 32 to dissipate at least some energy and to thereupon turn the one and/or the other screw 39 in order to select a new optimum radial position for the respective housing or housings. This constitutes a substantial improvement over the conventional methods of carrying out further adjustments because each and every component of a conventional vane pump is normally adjusted individually, not only radially but also axially of the axis of the rotor or rotors. Proper retention of various components of the two stages in desirable positions relative to each other and relative to the annular wall 18 is assisted by suction which is generated when the pump is operated during final radial adjustment of the housings 21, 24 by means of the screws 39, i.e., prior to tightening of the bolts 33 and resulting stressing of the springs 32. The provision of a spring-biased end wall or cover (20) is desirable on the additional ground that this simplifies the repair work and renders it possible to locate the reassembled components in optimum axial positions after repeated assembly and dismantling of the pump.

The improved fluid flow machine can be modified in a number of additional ways without departing from the spirit of the invention. For example, the machine can comprise a single stage or three or more stages. Each stage of the machine can constitute a module which is assembled of components identical with those of each other stage.

Furthermore, each housing (21, 24) can be yieldably biased by two or more spring-loaded abutments 40 or other suitable abutments which constitute or comprise resilient elements. For example, each of the housings 21, 24 can be biased by two abutments 40 which are disposed opposite the respective screw 39. This enables the screws 39 to move the respective housings 21, 24 substantially or exactly radially because each screw 39 and the respective abutments 40 are disposed at the corners of a preferably equilateral triangle with the screw 39 at the apex of the triangle.

The passages 35 in the partitions can be distributed in such a way that their axes are disposed along a spiral, i.e., the axis of each passage can be disposed at a different distance from the axis of the respective partition. This can be readily seen by observing the passages 35 in the partition 45 of FIG. 3. The partition 45 need not be provided with an axial hole or bore because it can be installed between the free end of the shaft 14 and the adjacent inner side of the end wall 20. The exact configuration of the spiral will depend upon the configuration of the pump chamber in the adjacent stage of the fluid flow machine.

The improved fluid flow machine can be used with equal or similar advantage as a single-stage or multistage compressor. The ratio of widths of the rotors or pistons is then selected (the same as in a machine which is used as a vacuum pump) in dependency upon the desired compression ratio. Still further, the improved fluid flow machine can be lubricated or can be operated as a dry-running (non-lubricated) vacuum generator or compressor.

The blind bore or hole 30*a* for one end portion of the pintle 28 can be replaced with a recess, e.g., with a radially inwardly extending recess which is open at its radially inner end to permit insertion of the respective end portion of the pintle in the radial and/or axial direction.

In order to secure the end wall or cover 20, the partition or partitions 23, 25 and the housing or housings 21, 24 to the extension 18 and its end wall 30 in any one of two or more different angular positions, the fixed end wall 30 can be provided with two or more bores or holes 30*a* (e.g., with four equidistant bores or holes 30*a*) for reception of the respective end of the pintle 28. The same result can be achieved by omitting the hole(s) or bore(s) 30*a* and by shortening the pintle 28 so that it need not extend into a bore or hole 30*a*. The shortened pintle 28 and the bolts 33 then constitute the only means for maintaining the parts 20, 21, 23, 24, 25 in any one of two or more different angular positions. As shown in FIG. 3, the end wall 20 is formed with a plurality of equidistant holes for the bolts 33 so that the pintle 28 and the parts 21, 23, 24, 25 on the pintle can be introduced into the extension 18 in any one of four different angular positions.

The selection of material for the fluid-contacting parts will or can depend upon the intended use of the improved pump. For example, the parts can be made of carbon if the pump is to be put to a first use, and the parts can be made of sintered bronze, a ceramic material or aluminum if the pump is to be put to a different second use. Such selection of any one of several different materials is possible because the fluid-contacting parts of the pump are simple so that the making of such parts does not or need not involve the utilization of specially designed tools and/or machines.

The housing 21 and/or 24 can be made of aluminum, a ceramic material, hard anodized aluminum, a TEFLON (registered trademark) impregnated material, cast iron, cast bronze or certain other materials. The rotor 22 and/or 26 can be made of electrographite, resin-impregnated electrographite, cast iron, cast bronze, hard anodized aluminum, a TEFLON (registered trademark) impregnated material or certain other materials. The material of the vanes 44 can be the same as that of the rotor or rotors.

The springs 32 constitute an optional feature of the improved pump. Thus, the end wall or cover 20 can be properly secured to the extension 18 without resorting to such springs; this is due to the satisfactory slidability of component parts of the stages and to the selected clearances.

As used in the appended claims, the term "pump" is intended to embrace fluid flow machines which are used as vacuum generating means as well as fluid flow machines which are used as compressors.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A vane pump for gaseous fluids comprising a rotor having a peripheral surface and at least one slot in said surface; a housing having an internal surface surrounding with clearance the peripheral surface of said rotor; a vane movable in said at least one slot and abutting said internal surface when said rotor is driven; a casing having an annular wall surrounding said housing and defining therewith a substantially annular narrow clearance, said housing being movable relative to said casing substantially radially of said rotor; means for moving said housing with reference to said casing in directions to change the narrow clearance of said internal surface with reference to said peripheral surface; and means for preventing rotation of said housing with said rotor, including means moulded in said casing and defining for said housing a pivot axis which is substantially parallel to said predetermined axis and permits a pivotal adjustment of said housing prior to actual use of the pump.

2. The vane pump of claim 1, wherein said housing is a circumferentially complete annulus.

3. The vane pump of claim 1, further comprising means for rotating said rotor about a predetermined axis.

4. The vane pump of claim 1, wherein said casing further comprises end walls flanking said rotor and said means defining said pivot axis includes a pintle having portions mounted in said end walls.

5. The vane pump of claim 1, wherein said means defining said pivot axis includes a pintle and said housing has a hole receiving a portion of said pintle with a clearance which at least matches the clearance between said housing and said annular wall.

6. The vane pump of claim 3, wherein said moving means comprises a threaded moving member rotatably mounted in and meshing with said annular wall.

7. The vane pump of claim 3, further comprising means for yieldably biasing said housing against said moving means.

8. The vane pump of claim 7, wherein said moving means comprises a threaded moving member mating with and rotatably mounted in said annular wall and having an inner end adjacent said housing, said biasing means including a spring-loaded abutment which is mounted in said annular wall and urges said housing against said inner end.

9. The vane pump of claim 3, further comprising a second rotor coaxial with said first named rotor and having a peripheral surface with at least one second slot, a second housing surrounding said second rotor and having an internal surface eccentric with reference to the peripheral surface of said second rotor, a second vane movable in said at least one second slot and abutting the internal surface of said second housing when said second rotor is driven, and a partition between said first named rotor and said first named housing on the one hand, and said second rotor and said second housing on the other hand.

10. The vane pump of claim 9, further comprising means for moving said second housing relative to said annular wall and said second rotor independently of said first named housing and substantially radially of said second rotor.

11. The vane pump of claim 9, wherein said second housing is identical with and is angularly offset relative to said first named housing through an angle of substantially 180°.

12. The vane pump of claim 9, wherein said first named rotor and said first named housing define at least one first pumping chamber having an outlet, said second housing and said second rotor defining at least one second pumping chamber having an inlet and said partition having at least one passage which establishes communication between said at least one outlet and said at least one inlet.

13. The vane pump of claim 3, wherein said casing further comprises a first end wall, a second end wall, and means for biasing one of said end walls toward the other of said end walls, said rotor and said housing being disposed between said end walls and being movable toward said other end wall in response to the application of bias to said one end wall.

14. The vane pump of claim 13, wherein said biasing means includes at least one spring which reacts against said annular wall and bears upon said one end wall.

15. The vane pump of claim 3, wherein said rotating means comprises a motor-driven shaft and elastic means for transmitting torque between said shaft and said rotor.

16. The vane pump of claim 15, wherein said shaft and said rotor have axially parallel grooves and said torque transmitting means includes a key in said grooves.

17. The vane pump of claim 3, wherein at least one of the components including said housing, said casing, said rotor and said vane is a molded plastic article.

18. The vane pump of claim 3, wherein at least one of the components including said casing, said housing, said vane and said rotor consists of carbon-containing synthetic material.

19. The vane pump of claim 3, wherein said casing further comprises a partition and an end wall, said rotor and said housing being disposed between said partition and said end wall and each of the components including said housing, said rotor, said partition and said end wall being secured to said annular wall in one of a plurality of different angular positions.

20. The vane pump of claim 3, wherein said casing further comprises two end walls flanking said rotor and said housing, one of said end walls having at least one fluid-admitting port and the other of said end walls having a gas-evacuating channel.

21. The vane pump of claim 20, wherein said rotating means includes a shaft extending through said other end wall toward said one end wall and said other end wall has a side facing said rotor and said housing, said channel constituting an annular groove in said side of said other end wall.

22. The vane pump of claim 3, wherein said rotor and said housing define a pumping chamber having portions of maximum and minimum width located in a first plane including said predetermined axis, said axes being located in a second plane which is substantially normal to said first plane.

23. A method of assembling a vacuum vane pump for gaseous fluids prior to actual use of the pump, comprising the steps of mounting a pump rotor in an annular wall for rotation about a predetermined axis; interposing an annular pump housing between the annular wall and the rotor in a position of eccentricity with reference to the rotor; and changing the eccentricity of the housing with reference to the rotor to select the vacuum generating action of the pump prior to actual use thereof, including inserting into the annular wall and into the housing a pintle so that the pintle defines a pivot axis about which the housing is pivotable relative to the annular wall.

24. The method claim 23, further comprising the steps of driving the rotor about said predetermined axis in the course of said changing step so that the vacuum generating action of the pump varies as a result of said changing step, and fixing the housing against movement relative to the rotor and the annular wall when the vacuum generating action of the pump reaches a desired value.

25. The method of claim 23 of assembling a multistage vane pump, further comprising the steps of mounting in the annular wall a second rotor for rotation about said predetermined axis, interposing a second annular pump housing between the second rotor and the annular wall in a position of eccentricity with reference to the second rotor, and changing the eccentricity of the second housing with reference to the second rotor independently of the first named housing.

26. The method of claim 25, wherein one of said eccentricity changing steps precedes the other of said eccentricity changing steps.

27. The method of claim 23, further comprising the step of moving the rotor and the housing to predetermined axial positions upon completion of said eccentricity changing step.

28. The method of claim 27, further comprising the step of subjecting the rotor and the housing to the action of at least one spring which yieldably maintains the housing and the rotor in said predetermined axial positions.

29. The method of claim 27, wherein said moving step includes positioning the rotor and the housing between two spaced-apart end walls and moving one of the end walls toward the other end wall in the direction of said predetermined axis.

30. The method of claim 29, further comprising the step of interposing between the annular wall and the one end wall at least one spring which reacts against the annular wall and bears against the one end wall to bias the rotor and the housing to said predetermined axial positions.

* * * * *